US010669895B2

(12) United States Patent
Taxacher et al.

(10) Patent No.: US 10,669,895 B2
(45) Date of Patent: Jun. 2, 2020

(54) SHROUD DAMPENING PIN AND TURBINE SHROUD ASSEMBLY

(71) Applicant: GENERAL ELECTRIC COMPANY, Schenectady, NY (US)

(72) Inventors: Glenn Curtis Taxacher, Simpsonville, SC (US); Herbert Chidsey Roberts, III, Middletown, OH (US); Randall Gill, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 222 days.

(21) Appl. No.: 15/623,899

(22) Filed: Jun. 15, 2017

(65) Prior Publication Data

US 2018/0363503 A1 Dec. 20, 2018

(51) Int. Cl.

| | |
|---|---|
| ***F01D 25/24*** | (2006.01) |
| ***F01D 25/00*** | (2006.01) |
| ***F01D 25/04*** | (2006.01) |

(52) U.S. Cl.

CPC ..... *F01D 25/246* (2013.01); *F01D 25/005* (2013.01); *F01D 25/04* (2013.01); (Continued)

(58) Field of Classification Search

CPC ..... F01D 5/225; F01D 5/22; F01D 25/246; F01D 25/005; F01D 11/08; F01D 9/04; (Continued)

(56) References Cited

U.S. PATENT DOCUMENTS 2,726,524 A * 12/1955 Gorin ..... B27B 5/32 464/45

6,315,519 B1 11/2001 Bagepalli et al.

(Continued)

FOREIGN PATENT DOCUMENTS

| | | |
|---|---|---|
| EP | 1529926 A2 | 5/2005 |
| EP | 2299061 A2 | 3/2011 |

OTHER PUBLICATIONS

Taxacher, et al.: "Turbine Component" filed Aug. 18, 2014 as U.S. Appl. No. 14/461,551 (not yet published).

*Primary Examiner* — Hung Q Nguyen
*Assistant Examiner* — Brian P Monahon
(74) *Attorney, Agent, or Firm* — McNees Wallace & Nurick LLC

(57) ABSTRACT

A shroud dampening pin is disclosed including a shaft, a dampening portion at a first end of the shaft, and a cap at a second end of the shaft. The dampening portion includes a bevel having a bevel angle and a contact surface. A turbine shroud assembly is disclosed, including an inner shroud, an outer shroud, the shroud dampening pin, and a biasing apparatus. The outer shroud includes a channel extending from an aperture adjacent to the inner shroud at a channel angle from the aperture. The shroud dampening pin is disposed within the channel. The dampening portion extends through the aperture with the contact surface contacting the inner shroud. The biasing apparatus contacts the cap and provides a biasing force to the inner shroud through the contact surface. The bevel angle is about the same as the channel angle, and the contact surface is about parallel to the aperture.

20 Claims, 3 Drawing Sheets

(52) U.S. Cl.
CPC ..... *F05D 2220/32* (2013.01); *F05D 2240/11* (2013.01); *F05D 2260/30* (2013.01); *F05D 2300/175* (2013.01)

(58) Field of Classification Search
CPC ... F01D 25/04; F05D 2260/30; F05D 2220/32
See application file for complete search history.

(56) References Cited

U.S. PATENT DOCUMENTS 6,726,448 B2 4/2004 McGrath et al.
6,758,653 B2 * 7/2004 Morrison ..... F01D 9/04 415/116
6,942,203 B2 9/2005 Schroder et al.
7,758,307 B2 * 7/2010 Van Heusden ..... F01D 9/042 415/209.2
8,047,773 B2 11/2011 Bruce et al.
8,167,546 B2 5/2012 Shi et al.
10,240,476 B2 * 3/2019 Varney ..... F01D 11/24
2003/0215328 A1 * 11/2003 McGrath ..... F01D 11/12 415/173.3
2005/0158168 A1 * 7/2005 Bruce ..... F01D 9/04 415/173.1
2005/0214116 A1 * 9/2005 Proveaux ..... F01D 25/246 415/209.2
2007/0280820 A1 * 12/2007 Roberts ..... F01D 11/08 415/139
2008/0087021 A1 * 4/2008 Radonovich ..... F01D 11/122 60/752
2008/0178465 A1 * 7/2008 Schiavo ..... F01D 25/246 29/889.21
2009/0053050 A1 * 2/2009 Bruce ..... F01D 25/04 415/200
2009/0169395 A1 * 7/2009 Wilson, Jr. ..... F01D 5/28 416/97 R
2010/0034657 A1 * 2/2010 Hunt ..... F01D 5/22 416/190
2012/0204398 A1 * 8/2012 Herbold ..... B23B 47/284 29/426.2
2014/0087907 A1 * 3/2014 Coffin ..... F16H 57/0479 475/159
2017/0044923 A1 2/2017 Roberts et al.
2017/0051627 A1 2/2017 Hafner et al.
2018/0363498 A1 * 12/2018 Taxacher ..... F01D 25/04
2018/0363504 A1 * 12/2018 Taxacher ..... F01D 5/22

* cited by examiner

SHROUD DAMPENING PIN AND TURBINE SHROUD ASSEMBLY

FIELD OF THE INVENTION

The present invention is directed to shroud dampening pins and turbine shroud assemblies. More particularly, the present invention is directed to shroud dampening pins and turbine shroud assemblies wherein the shroud dampening pin includes a dampening portion having a bevel.

BACKGROUND OF THE INVENTION

Hot gas path components of gas turbines are subjected to high air loads and high acoustic loads during operation which, combined with the elevated temperatures and harsh environments, may damage the components over time. Both metal and ceramic matrix composite ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation.

BRIEF DESCRIPTION OF THE INVENTION

In an exemplary embodiment, a shroud dampening pin includes a shaft, a dampening portion, and a cap. The dampening portion is disposed at a first end of the shaft, and the dampening portion includes a bevel. The bevel has a bevel angle and includes a contact surface. The cap is disposed at a second end of the shaft distal from the first end of the shaft.

In another exemplary embodiment, a turbine shroud assembly includes an inner shroud, an outer shroud, a shroud dampening pin, and a biasing apparatus. The inner shroud is arranged to be disposed adjacent to a hot gas path. The outer shroud is adjacent to the inner shroud and arranged to be disposed distal from the hot gas path across the inner shroud. The outer shroud includes a channel extending from an aperture adjacent to the inner shroud at a channel angle from the aperture. The shroud dampening pin is disposed within the channel and in contact with the inner shroud. The shroud dampening pin includes a shaft, a dampening portion, and a cap. The dampening portion is disposed at a first end of the shaft, extends through the aperture, and includes a bevel. The bevel has a bevel angle and includes a contact surface in contact with the inner shroud. The cap is disposed at a second end of the shaft distal from the first end of the shaft. The biasing apparatus is in contact with the cap and provides a biasing force away from the outer shroud along the shroud dampening pin to the inner shroud through the contact surface. The bevel angle is about the same as the channel angle, and the contact surface is about parallel to the aperture.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary shroud dampening pins and turbine shroud assemblies. Embodiments of the present disclosure, in comparison to articles not utilizing one or more features disclosed herein, decrease costs, improve mechanical properties, increase component life, decrease maintenance requirements, or combinations thereof.

Figure 1:
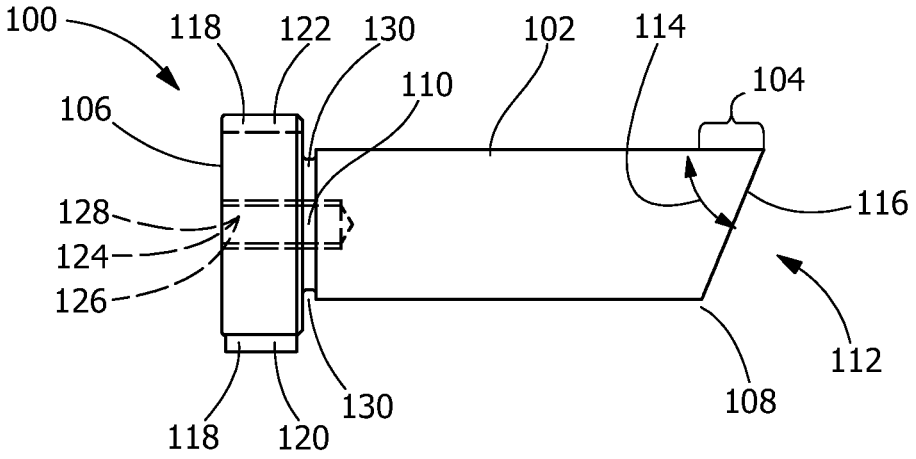
FIG. 1 is a side view of a shroud dampening pin, according to an embodiment of the present disclosure.
Figure 2:
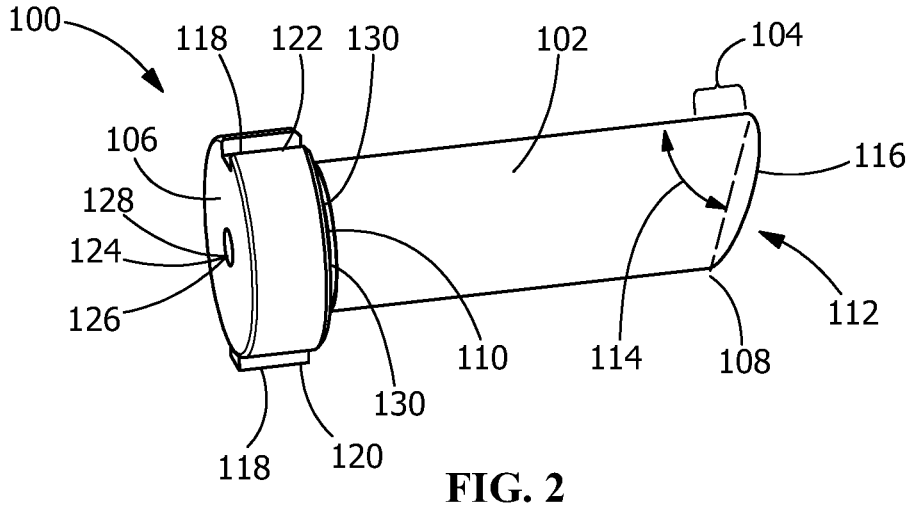
FIG. 2 is a left perspective view of the shroud dampening pin of FIG. 1 having an axial protrusion clocking feature, according to an embodiment of the present disclosure.
Figure 3:
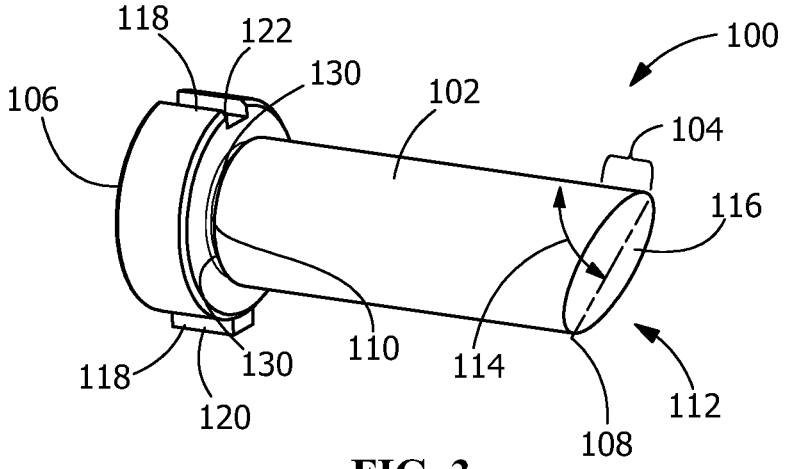
FIG. 3 is a right perspective view of the shroud dampening pin of FIG. 1 having an axial groove, according to an embodiment of the present disclosure.

Referring to FIGS. 1-3, in one embodiment, a shroud dampening pin 100 includes a shaft 102, a dampening portion 104, and a cap 106. The dampening portion 104 is disposed at a first end 108 of the shaft 102, and the dampening portion 104 includes a bevel 112. The bevel 112 has a bevel angle 114 and includes a contact surface 116. The cap 106 is disposed at a second end 110 of the shaft 102 distal from the first end 108 of the shaft 102.

In one embodiment, the cap 106 includes a clocking feature 118. The clocking feature 118 may include an axial protrusion 120, an axial groove 122, or both.

The cap 106 may include an extraction interface 124. In one embodiment, the extraction interface 124 includes a bore 126. The bore 126 may be a threaded bore 128 or may include any suitable securing feature for a tool to exert a pulling force upon.

In one embodiment, the shaft 102 includes a circumferential relief groove 130 directly adjacent to the cap 106.

The bevel angle 114 may be any suitable angle, including, but not limited to, an angle between about 15° to about 75°, alternatively between about 20° to about 70°, alternatively between about 25° to about 65°, alternatively between about 15° to about 45°, alternatively between about 20° to about 50°, alternatively between about 25° to about 55°, alternatively between about 30° to about 60°, alternatively between about 35° to about 65°, alternatively between about 40° to about 70°, alternatively between about 45° to about 75°, alternatively between about 35° to about 55°, alternatively between about 40° to about 50°, alternatively between about 45°.

The shroud dampening pin 100 may include any suitable material composition, including, but not limited to, high alloy steels, CrMo steels, superalloys, nickel-based superalloys, cobalt-based superalloys, cobalt L-605, CRUCIBLE 422, INCONEL 718, INCONEL X-750, or combinations thereof.

As used herein, "high alloy steel" refers to a steel that, in additional to carbon, iron is alloyed with at least, by weight, about 4% additional elements, alternatively at least about 8% additional elements. Suitable additional elements include, but are not limited to, manganese, nickel, chromium, molybdenum, vanadium, silicon, boron, aluminum, cobalt, cerium, niobium, titanium, tungsten, tin, zinc, lead, and zirconium.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "CrMo steel" refers to a steel alloyed with at least chromium and molybdenum. In one embodiment, the CrMo steels are 41xx series steels as specified by the Society of Automotive Engineers.

As used herein, "CRUCIBLE 422" refers to an alloy including a composition, by weight, of about 11.5% chromium, about 1% molybdenum, about 0.23% carbon, about 0.75% manganese, about 0.35% silicon, about 0.8% nickel, about 0.25% vanadium, and a balance of iron. CRUCIBLE 422 is available from Crucible Industries LLC, 575 State Fair Boulevard, Solvay, N.Y., 13209.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

Referring to FIGS. 4-7, in one embodiment, a turbine shroud assembly 400 includes an inner shroud 402, an outer shroud 404, a shroud dampening pin 100, and a biasing apparatus 406. The inner shroud 402 is arranged to be disposed adjacent to a hot gas path 408. The outer shroud 404 is adjacent to the inner shroud 402 and arranged to be disposed distal from the hot gas path 408 across the inner shroud 402. The outer shroud 404 includes a channel 410 extending from an aperture 412 adjacent to the inner shroud 402 at a channel angle 414 from the aperture 412. The shroud dampening pin 100 is disposed within the channel 410 and in contact with the inner shroud 402. The dampening portion 104 of the shroud dampening pin 100 extends through the aperture 412, and the contact surface 116 is in contact with the inner shroud 402. The biasing apparatus 406 is in contact with the cap 106 and provides a biasing force 416 away from the outer shroud 404 along the shroud dampening pin 100 to the inner shroud 402 through the contact surface 116. The channel angle 414 is about the same as the bevel angle 114, and the contact surface 116 is about parallel to the aperture 412. The turbine shroud assembly 400 may include a plurality of shroud dampening pins 100 disposed within a plurality of channels 410.

In one embodiment, wherein the cap 106 includes a clocking feature 118, the channel 410 includes an alignment feature 418 which mates with the clocking feature 118. The channel 410 may include an aligning groove 420 to mate with an axial protrusion 120, an aligning protrusion 422 to mate with an axial groove 122, or both.

The contact surface 116 may contact the inner shroud 402 in any suitable location, including, but not limited to, a hook region 424 of the inner shroud 402 extending over a portion of the outer shroud 404. In one embodiment, the shroud dampening pin 100 exerts both an axial dampening force 426 and a radial dampening force 428 on the inner shroud 402. Without being bound by theory, it is believed that the provision of an axial dampening force 426 and a radial dampening force 428 on the hook region 424 provide more effective dampening of the hook region 424 of the inner shroud 402 than an axial dampening force 426 or a radial dampening force 428 alone.

The inner shroud 402 may include any suitable material composition, including, but not limited to, CMCs, aluminum oxide-fiber-reinforced aluminum oxides (Ox/Ox), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$), superalloys, nickel-based superalloys, cobalt-based superalloys, INCONEL 718, INCONEL X-750, cobalt L-605, or combinations thereof.

The outer shroud 404 may include any suitable material composition, including, but not limited to, iron alloys, steels, stainless steels, carbon steels, nickel alloys, superalloys, nickel-based superalloys, INCONEL 738, cobalt-based superalloys, or combinations thereof.

In one embodiment, the biasing force 416 is sufficient to dampen or eliminate contact and stresses between the inner shroud 402 and the outer shroud 404 generated by air loads and acoustic loads from the hot gas path 408 during operation.

Figure 4:
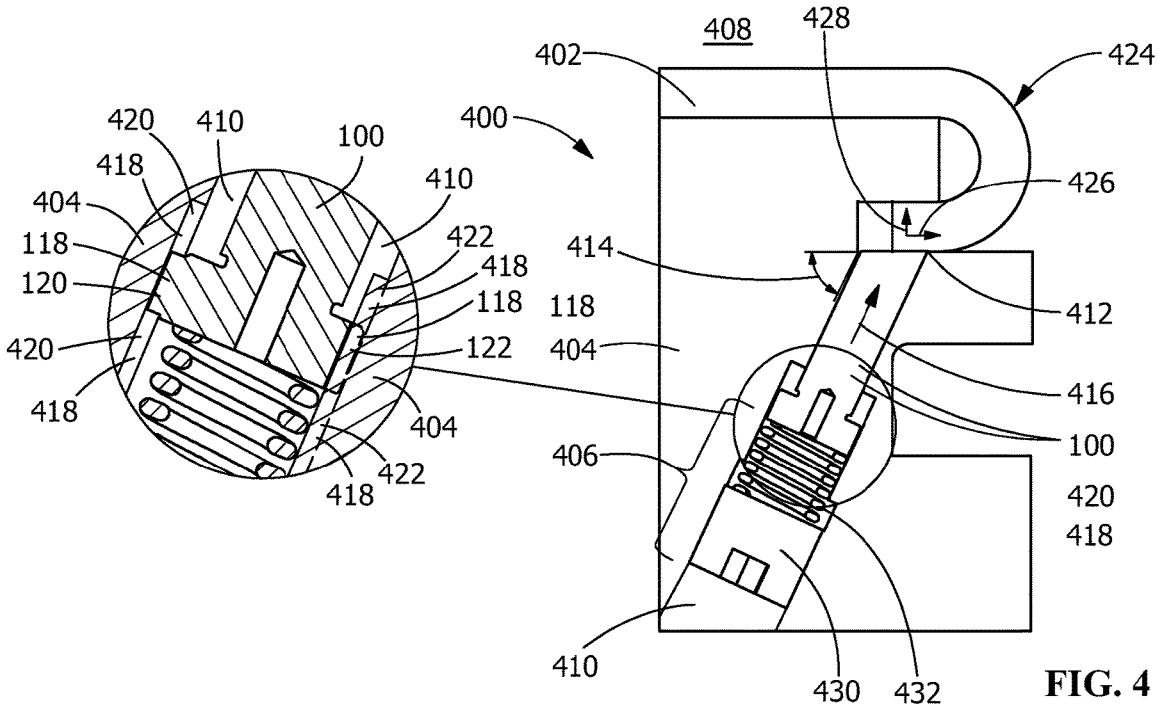
FIG. 4 is a cross-sectional view of a turbine shroud assembly having a spring, according to an embodiment of the present disclosure.

Referring to FIG. 4, the biasing apparatus 406 may be any suitable apparatus capable of providing the biasing force 416 through the shroud dampening pin 100 to the inner shroud 402. In one embodiment, the biasing apparatus 406 includes a plug 430 disposed in the channel 410, and a spring 432 disposed in the channel 410 between the plug 430 and the cap 106. The plug 430 compresses the spring 432, exerting the biasing force 416. The plug 430 may be threaded into the channel 410 to provide adjustability to the compression of the spring 432 and the biasing force 416. As used herein, "spring" 432 is a spring coil.

Figure 5:
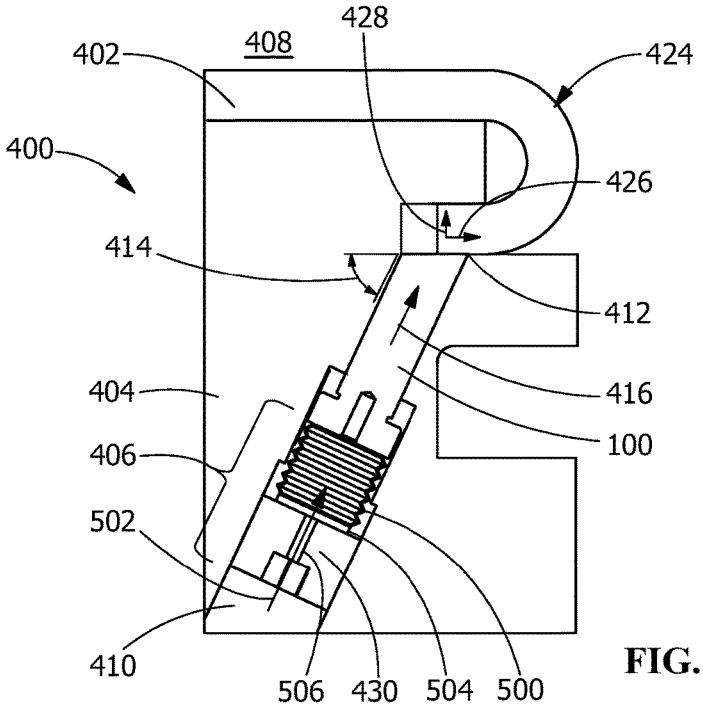
FIG. 5 is a cross-sectional view of a turbine shroud assembly having a bellows, according to an embodiment of the present disclosure.
Figure 6:
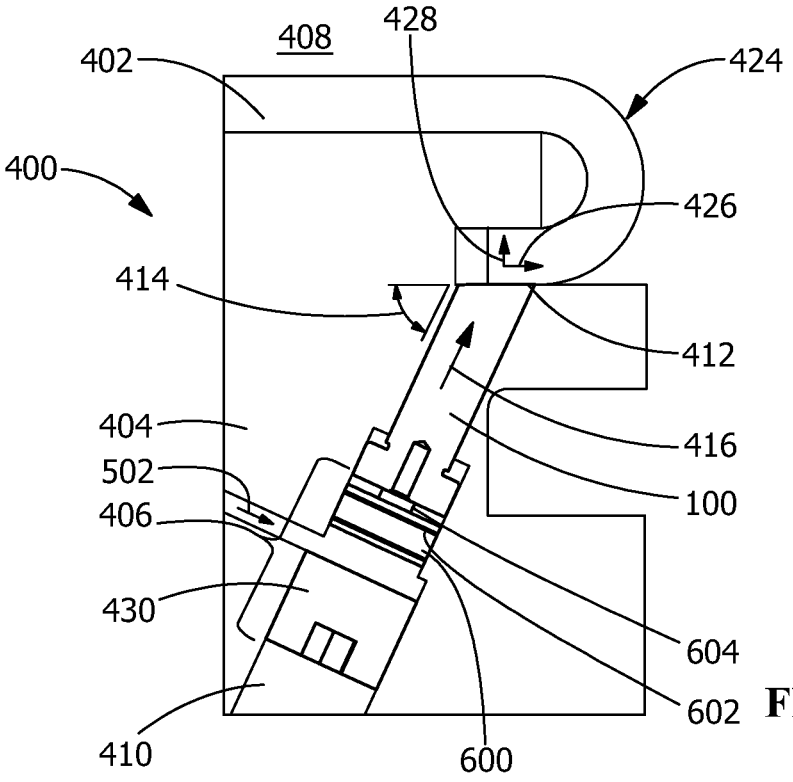
FIG. 6 is a cross-sectional view of a turbine shroud assembly having a thrust piston, according to an embodiment of the present disclosure.
Figure 7:
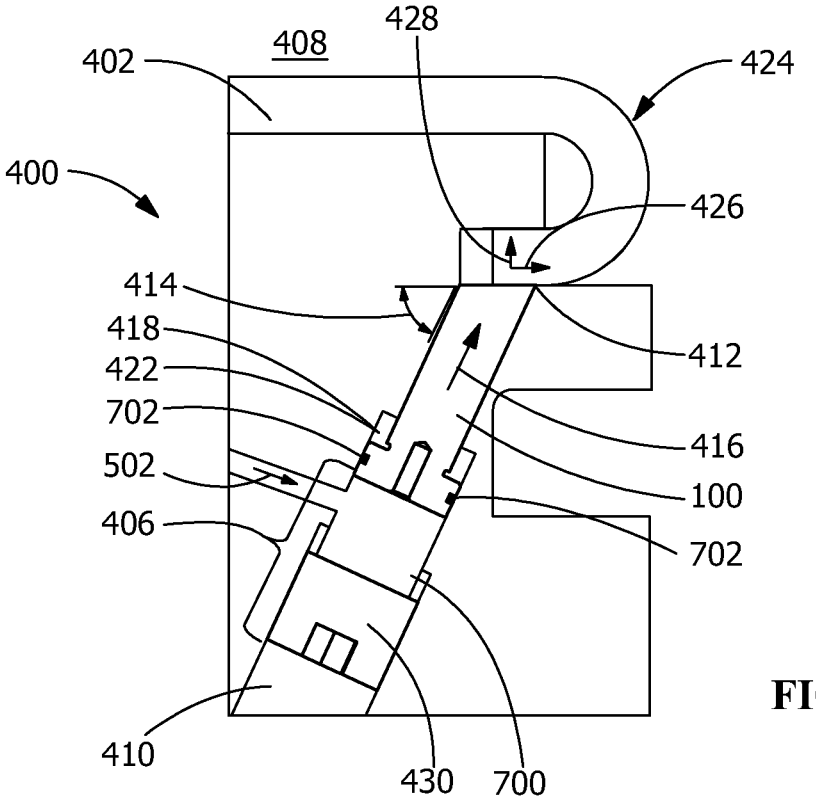
FIG. 7 is a cross-sectional view of a turbine shroud assembly having a pressurized cavity, according to an embodiment of the present disclosure.

Referring to FIGS. 5-7, the biasing apparatus 406 may be a springless biasing apparatus. As using herein, "springless" indicates the lack of a spring coil. In one embodiment, the biasing apparatus 406 is driven by a pressurized fluid 502 either in addition to or in lieu of a spring 432. The pressurized fluid 502 may be adjustable.

Referring to FIG. 5, in one embodiment, the biasing apparatus 406 includes at least one bellows 500 configured to expand in response to an increased internal pressure within the at least one bellows 500 and to exert the biasing force 416. The bellows 500 may be secured in place by a plug 430, and the plug 430 may be threaded into the channel 410 to provide adjustability to the position of the bellows 500. The bellows 500 may be driven by the pressurized fluid 502. As used herein, "bellows" includes a pressurized bladder. The pressurized fluid 502 may enter the bellows 500 through an endplate 504 of the bellows 500. In one embodiment, a fluid channel 506 passes through the plug 430 and the endplate 504 into the bellows 500. The endplate 504 may be welded to the plug 430.

Referring to FIG. 6, in one embodiment, the biasing apparatus 406 includes at least one thrust piston 600 configured to translate toward the shroud dampening pin 100 in response to a pressurized fluid 502 and to exert the biasing force 416. A plug 430 may form a seal for the pressurized fluid 502 or may secure a seal for the pressurized fluid 502 in place. The thrust piston 600 includes a piston head 602, and may include a stanchion 604 attached to the piston head 602 and operating on the shroud dampening pin 100, or the piston head 602 may operate on the shroud dampening pin 100 directly without a stanchion 604 (not shown).

Referring to FIG. 7, in one embodiment, the biasing apparatus 406 includes a plug 430 disposed in the channel 410, a pin seal 702, and a pressurized cavity 700 disposed between the plug 430 and the shroud dampening pin 100. The plug 430 may form a seal for the pressurized fluid 502 in the pressurized cavity 700 or may secure a seal for the pressurized fluid 502 in place. The pressurized fluid 502 directly exerts the biasing force 416 on the shroud dampening pin 100. The pin seal 702 may be disposed on the cap 106, the shaft 102, the channel 410 adjacent to the cap 106, the channel 410 adjacent to the shaft 102, or a combination thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A shroud dampening pin, comprising:
a shaft;
a dampening portion disposed at a first end of the shaft, the dampening portion including a bevel having a bevel angle, the bevel including a contact surface; and
a cap disposed at a second end of the shaft distal from the first end of the shaft,
wherein the cap includes:
a clocking feature including an axial groove, an axial protrusion, or both the axial groove and the axial protrusion;
an extraction interface including a threaded bore; or
both the clocking feature and the extraction interface.

2. A turbine shroud assembly, comprising:
an inner shroud arranged to be disposed adjacent to a hot gas path;
an outer shroud adjacent to the inner shroud and arranged to be disposed distal from the hot gas path across the inner shroud, the outer shroud including a channel extending from an aperture adjacent to the inner shroud at a channel angle from the aperture;
a shroud dampening pin disposed within the channel and in contact with the inner shroud, the shroud dampening pin including:
a shaft;
a dampening portion disposed at a first end of the shaft and extending through the aperture, the dampening portion including a bevel having a bevel angle, the bevel including a contact surface in contact with the inner shroud; and
a cap disposed at a second end of the shaft distal from the first end of the shaft; and
a biasing apparatus in contact with the cap, the biasing apparatus providing a biasing force away from the outer shroud along the shroud dampening pin to the inner shroud through the contact surface,
wherein the bevel angle is about the same as the channel angle, and the contact surface is about parallel to the aperture, and
wherein the cap includes:
a clocking feature including an axial groove, an axial protrusion, or both the axial groove and the axial protrusion;
an extraction interface including a threaded bore; or
both the clocking feature and the extraction interface.

3. The turbine shroud assembly of claim 2, wherein the cap includes the clocking feature.

4. The turbine shroud assembly of claim 2, wherein the cap includes the extraction interface.

5. The turbine shroud assembly of claim 2, wherein the cap includes both the clocking feature and the extraction interface.

6. The turbine shroud assembly of claim 2, wherein the shaft includes a circumferential relief groove directly adjacent to the cap.

7. The turbine shroud assembly of claim 2, wherein the bevel angle is between about 15° to about 75° .

8. The turbine shroud assembly of claim 2, wherein the shroud dampening pin includes a material composition selected from the group consisting of high alloy steels, CrMo steels, superalloys, nickel-based superalloys, cobalt-based superalloys, cobalt L-605, CRUCIBLE 422, INCONEL 718, INCONEL X-750, and combinations thereof.

9. The turbine shroud assembly of claim 3, wherein the clocking feature mates with an alignment feature in the channel;
the clocking feature including the axial groove and the alignment feature including the aligning protrusion;
the clocking feature including the axial protrusion and the alignment feature including the aligning groove; or both.

10. The turbine shroud assembly of claim 2, wherein the bevel angle and the channel angle are between about 15° to about 75° .

11. The turbine shroud assembly of claim 2, further including a plurality of shroud dampening pins disposed within a plurality of channels.

12. The turbine shroud assembly of claim 2, wherein the biasing apparatus includes a plug disposed in the channel, and a spring disposed in the channel between the plug and the cap, the plug compressing the spring, exerting the biasing force.

13. The turbine shroud assembly of claim 2, wherein the biasing apparatus is a springless biasing apparatus.

14. The turbine shroud assembly of claim 2, wherein the biasing apparatus is driven by a pressurized fluid.

15. The turbine shroud assembly of claim 14, wherein the biasing apparatus includes at least one bellows configured to expand in response to an increased internal pressure within the at least one bellows and to exert the biasing force.

16. The turbine shroud assembly of claim 14, wherein the biasing apparatus includes at least one thrust piston configured to exert the biasing force.

17. The turbine shroud assembly of claim 14, wherein the biasing apparatus includes a plug disposed in the channel, a pin seal, and a pressurized cavity disposed between the plug and the shroud dampening pin, and the pressurized fluid directly exerts the biasing force on the shroud dampening pin.

18. The turbine shroud assembly of claim 2, wherein the contact surface contacts the inner shroud in a hook region of the inner shroud extending over a portion of the outer shroud.

19. The turbine shroud assembly of claim 2, wherein the shroud dampening pin exerts both an axial dampening force and a radial dampening force on the inner shroud.

20. A turbine shroud assembly, comprising:

an inner shroud arranged to be disposed adjacent to a hot gas path;

an outer shroud adjacent to the inner shroud and arranged to be disposed distal from the hot gas path across the inner shroud, the outer shroud including a channel extending from an aperture adjacent to the inner shroud at a channel angle from the aperture;

a shroud dampening pin disposed within the channel and in contact with the inner shroud, the shroud dampening pin including:

a shaft;

a dampening portion disposed at a first end of the shaft and extending through the aperture, the dampening portion including a bevel having a bevel angle, the bevel including a contact surface in contact with the inner shroud; and a cap disposed at a second end of the shaft distal from the first end of the shaft; and a biasing apparatus in contact with the cap, the biasing apparatus providing a biasing force away from the outer shroud along the shroud dampening pin to the inner shroud through the contact surface, wherein the bevel angle is about the same as the channel angle, and the contact surface is about parallel to the aperture, and wherein the biasing apparatus is driven by a pressurized fluid.

* * * * *